US008066112B2

(12) United States Patent
Klabisch et al.

(10) Patent No.: US 8,066,112 B2
(45) Date of Patent: Nov. 29, 2011

(54) CONNECTOR DEVICE FOR TROUGH PANS ON MINING EQUIPMENT TROUGH PAN AND ASSEMBLY COMPONENT FOR THE SAME

(75) Inventors: Adam Klabisch, Dortmund (DE); Gerhard Siepenkort, Lunen (DE); Klaus Duhnke, Werne (DE); Norbert Hesse, Bochum (DE); Henrik Padberg, Arnsberg (DE)

(73) Assignee: Bucyrus Europe GmbH, Lünen (DE)

( * ) Notice: Subject to any disclaimer, the term of this patent is extended or adjusted under 35 U.S.C. 154(b) by 0 days.

(21) Appl. No.: 12/864,010

(22) PCT Filed: Jan. 13, 2009

(86) PCT No.: PCT/EP2009/000146

§ 371 (c)(1),
(2), (4) Date: Jul. 22, 2010

(87) PCT Pub. No.: WO2009/092535

PCT Pub. Date: Jul. 30, 2009

(65) Prior Publication Data

US 2010/0288604 A1 Nov. 18, 2010

(30) Foreign Application Priority Data

Jan. 23, 2008 (DE) ..... 10 2008 005 740

(51) Int. Cl.
*B65G 19/18* (2006.01)

(52) U.S. Cl. ..... 198/735.1; 198/735.2; 198/860.2

(58) Field of Classification Search ..... 198/735.1, 198/735.2, 735.6, 860.2
See application file for complete search history.

(56) References Cited

U.S. PATENT DOCUMENTS

| | | | | |
|---|---|---|---|---|
| 3,842,966 | A * | 10/1974 | Blumenthal et al. | 198/735.1 |
| 4,134,489 | A * | 1/1979 | Sabes | 198/735.6 |
| 4,420,075 | A * | 12/1983 | Skolik et al. | 198/735.2 |
| 4,965,929 | A * | 10/1990 | Aligue | 198/735.1 |
| 5,605,220 | A * | 2/1997 | Krohm | 198/735.6 |
| 7,562,764 | B2 * | 7/2009 | Schmidt et al. | 198/735.6 |
| 2006/0070859 | A1 * | 4/2006 | Pahlow et al. | 198/860.1 |

FOREIGN PATENT DOCUMENTS

| | | | |
|---|---|---|---|
| DE | 2040678 | A1 | 2/1972 |
| DE | 202004001476 | U1 | 4/2004 |
| GB | 800864 | A | 9/1958 |
| GB | 1145247 | | 3/1969 |

* cited by examiner

*Primary Examiner* — James R Bidwell
(74) *Attorney, Agent, or Firm* — Rankin, Hill & Clark LLP

(57) ABSTRACT

A connector device for connecting an attachment part, in particular a plough guide part, to a lateral element of a trough pan of a mining device, comprising first fittings arranged on the lateral element, comprising counter fittings arranged on the attachment part and detachably connectable to the fittings, and comprising at least one retaining piece, which in the closing position prevents detachment of the fitting and counter fitting and in the opening position permits detachment. In order to facilitate assembly and disassembly, to the retaining piece there is assigned, according to the invention, a hydraulic cylinder for moving the retaining piece between the closing and opening position.

18 Claims, 4 Drawing Sheets

CONNECTOR DEVICE FOR TROUGH PANS ON MINING EQUIPMENT TROUGH PAN AND ASSEMBLY COMPONENT FOR THE SAME

This application claims priority to and the benefit of the filing date of International Patent Application No. PCT/EP2009/000146, filed Jan. 13, 2009, which application claims priority to and the benefit of the filing date of German Patent Application No. 10 2008 005 740.1, filed Jan. 23, 2008.

FIELD OF THE INVENTION

The invention generally relates to a connector device for connecting an attachment part, in particular a plough guide part, to a lateral element of a trough pan of a mining device, comprising first fittings arranged on the lateral element, comprising counter fittings arranged on the attachment part and detachably connectable to the fittings, and comprising at least one retaining piece, which in the closing position prevents detachment of the fitting and counter fitting and in the opening position permits detachment. The invention further generally relates to a trough pan with detachable attachment part, in particular with detachable machine guide, for mining equipment for mineral mining, wherein the attachment part can be detachably fastened to the trough pan by means of a connector device which has fittings on the trough pan, counter fittings on the attachment part, and at least one retaining piece, which in the closing position prevents detachment of the fitting and counter fitting. The invention also generally relates to an attachment part for a trough pan or for a corresponding connector device.

BACKGROUND

In underground mining equipment, for example for coal mining, mining machines are used which are moved to and fro along a conveying device for the won coal. In mining equipment of this type, which can be up to 400 m in length, special pans are respectively arranged in the longwall end region, particularly in plough systems, so as to create the necessary structural space not only to be able to draw the plough into the longwall end region, but also to be able to arrange the drives for the plough in the longwall end region.

Corresponding special pans can consist, in particular, of so-called wedge pans, in which the machine guide acquires over the length of the trough pan an increasingly greater distance from the lateral element, and can consist of connector pans, in which the distance apart of the top strand and bottom strand is increased so as subsequently to redirect the chain around a chain wheel. Particularly in the case of these special pans, machine guide parts are used which can be detached from the trough pan to allow the installation, disassembly or repair of a plough, the replacement of sliding blocks on the plough, or the execution of other maintenance works on the plough. The fastening between the detachable machine guide part and the trough pan is realized by connector devices having a fitting and a counter fitting which can be locked in place with at least one retaining piece. The main field of application of the present invention relates to corresponding wedge pans and connector pans having detachable machine guides as the attachment part to the trough pan. However, the invention is also fundamentally applicable on other attachment parts which need to be detached from the trough pan.

A connector device of the generic type is known from DE 20 2004 001 476 U1, and the known connector device comprises, inter alia, hook elements in the lower region of the lateral elements, into which the removable machine guide part can be inserted by means of mounting pieces, so that in the lower region a separable hook coupling is obtained. With the retaining piece, in the connector device of the generic type, the attachment part and the lateral element have only to be prevented from swiveling apart, for which purpose the retaining piece is configured either as a screw-on locking bar or in the form of crescent-shaped bushings which project over the lateral part and, in turn, are secured against detachment by means of a screw bolt. Through the use of the hook coupling, the attachment of the machine guide can certainly be facilitated. However, the release, in particular, of the screw bolts is laborious and time consuming, and can be made considerably more difficult, in particular, by sticking of the bolts, the bushings or the locking bar.

SUMMARY

An object of the invention is to provide a connector device, together with trough pan and attachment part, in which the attachment part can be quickly and easily removed.

According to an aspect of the invention, this object can be achieved in respect of the connector device by virtue of the fact that to the retaining piece there is assigned a hydraulic cylinder for moving the retaining piece between the closing and opening position. By virtue of the inventively used hydraulic cylinder for actuation of the retaining piece, it is possible, provided that suitable hydraulic cylinders are chosen, for even a jammed retaining piece to be moved without difficulty from the closing into the opening position (and vice versa), in which case, in particular, the opportunity is presented to provide the hydraulic pressure for the hydraulic loading of the hydraulic cylinder with the longwall hydraulics. A solution according to the invention, in particular the utilization of a hydraulic cylinder, can be employed by the miner virtually without a tool, since the hydraulic cylinder has merely to be supplied with hydraulic pressure. To this end, it may be sufficient, as will be further explained, to connect the hydraulic cylinder to the anyway present longwall hydraulics, where appropriate, only for a short time.

In a preferred embodiment, two retaining pieces are provided and to each retaining piece there is respectively assigned a hydraulic cylinder. With two retaining pieces, at two mutually spaced positions, fittings and counter fittings can be locked against detachment, so that the attachment part and the trough pan are locked in place with minimum effort, secure against any relative movements one to another. It can be particularly advantageous if each of the two hydraulic cylinders has an extensible and retractable piston rod connected to the associated retaining piece, the hydraulic cylinders preferably being provided with piston rods lying aligned on an axis and being arranged laterally inverted on the lateral element of the trough pan in such a way that the distance apart of the retaining pieces in the closing position is greater than in the opening position. Particularly in this arrangement of the piston rods of hydraulic cylinders, but also in differently positioned hydraulic cylinders with piston rods, it is advantageous if both hydraulic cylinders have a common hydraulic connection for the extension movement and a separate common hydraulic connection for the retraction movement of the piston rods. For the detachment or locking of the connector device, a miner has then only to connect, for example, the longwall hydraulics to the correct hydraulic connection in order to move the hydraulic cylinders in such a way that the retaining piece respectively acquires the desired position.

Further, each fitting and counter fitting has first and second locking or positive locking means, which are spaced apart one above the other with an interspace and which, in the assembled state, interlock, and the retaining piece can respectively be slid into or out of the interspace. Particularly the lower positive locking means could also form a hook coupling, as known from the generic prior art. The upper fittings and counter fittings could then include bars or the like arranged one behind the other, which are provided with window cutouts, into which, in the assembly position, the retaining piece is inserted. Alternatively, the counter fittings can be configured as hook elements, which can be hung in grooves on the fittings, preferably both the upper and the lower fittings and counter fittings respectively including pairs of hook elements and grooves, since this embodiment makes do with relatively little structural space.

In another embodiment, the fittings can include C-shaped profiled parts having end members and a transverse member rigidly connecting these same, the transverse member preferably containing a transverse bore for receiving a centering element for the centering and connection of trough pans arranged one behind the other. The centering elements are used, in particular, when the detachable attachment parts, which are preferably provided with suitable toggle sockets for the reception of connecting toggles, are not yet installed, or are disassembled, in order that there is no risk of the trough pans being able to be pushed apart once the plough guide parts are disassembled.

It can be further advantageous if the retaining pieces rest displaceably on guide pieces attached, in particular welded, to the lateral element. As a result of the interplay between the guide piece and the piston rod, a secure guidance of the retaining pieces parallel to the lateral part of the trough pans can thus be achieved with relatively simple means, without the risk of guides for the retaining pieces becoming clogged by fine coal agglomerations or the like. The fittings and counter fittings can include, in particular, of strong bars of several centimeters length, which allow a hanging fastening of the attachment part to the lateral element. As explained further above, the fittings and counter fittings can also however, in the lower region of a hook coupling and in the upper region, include mutually parallel locking bars. Expediently, the retaining pieces are movable parallel to the lateral element and/or horizontally.

The above-stated object can be achieved in a trough pan according to an aspect of the invention by the fact that the connector device has a hydraulic cylinder, assigned to the retaining piece and abutted against the lateral element, for moving the retaining piece between an opening and a closing position in which the retaining piece prevents detachment of the fitting and counter fitting. The connector device can, in particular, be provided with the features described further above, in order to achieve the advantages stated there. The attachment part, in particular the machine guide, can include plough guide parts, in particular of plough guide parts for wedge or connector pans in the end region of a mining device.

The attachment part which according to the invention can be usable with such a connector device or with a corresponding trough pan can be configured, in particular, as a plough guide part and can be provided between the counter fittings with a removable closing plate in order, when the closing plate is removed, to expose the hydraulic connections for actuating the hydraulic cylinders of the connector device. The attachment part according to an aspect of the invention hence has located thereon only the counter fittings, plus a protective cover for the hydraulic cylinders, plus the hydraulic connections to the lateral part of the trough pan, so that the hydraulic cylinders, when the plough guide is fitted, lie protected between a rear wall of the plough guide part and the lateral element of the trough pan.

BRIEF DESCRIPTION OF THE DRAWINGS

Further advantages and embodiments of a connector device according to the invention will become clear from the following description of an illustrative embodiment of a trough pan with corresponding connector device, as well as of a plough guide which is installable or installed thereon. In the drawing.

DETAILED DESCRIPTION

Figure 1:
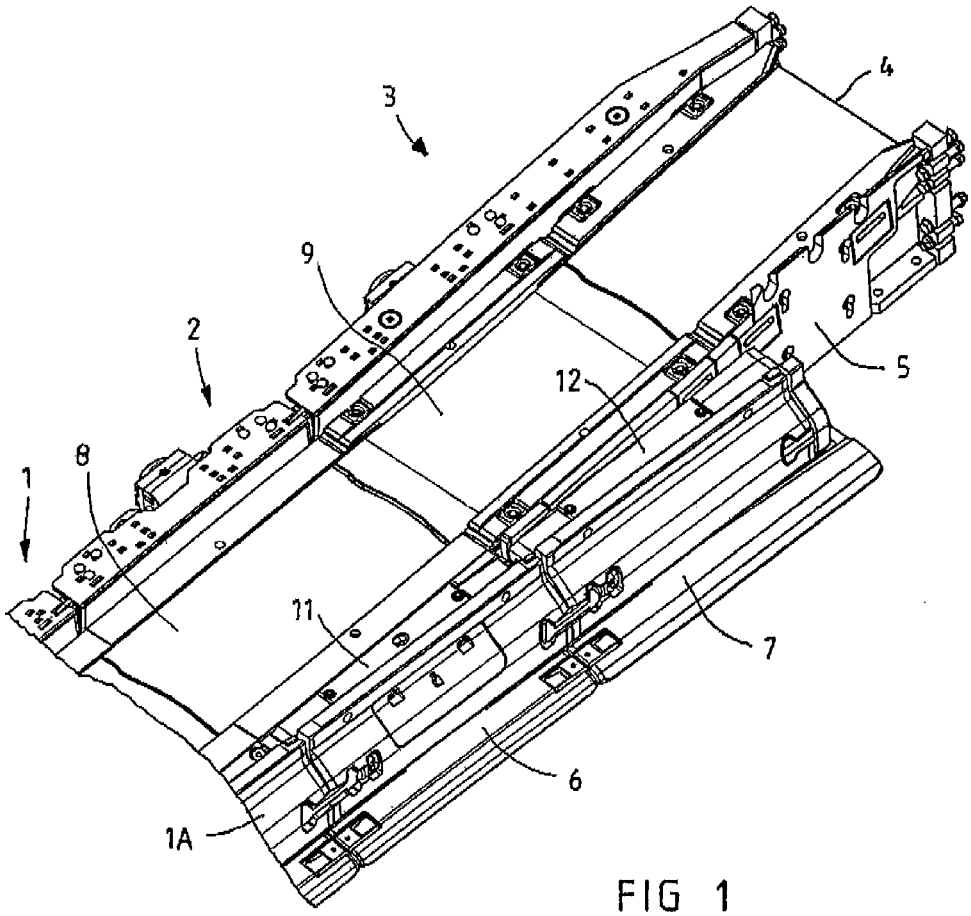
FIG. 1 shows of a plough guide device, in perspective representation, a wedge pan and a connector pan with detachable plough guide part.

In FIG. 1 are represented, of a mining device (otherwise not further represented), a normal pan 1, a wedge pan 2 and a connector pan 3, to the head 4 of which latter can be connected, in a manner which is known per se, a machine frame with chain wheels for the conveyor chain (not represented) and the plough chain (not represented) for moving a mining plough (likewise not represented) as a mining machine. The three represented pans 1, 2, 3 hence form the transition region or end region of a conveyor pan with connected plough guide, which conveyor pan includes a multiplicity of normal pans 1 and is placed in the longwall, though a plurality of wedge pans 2 could also be present before the conveyor chain belt is fed to the machine frame via the connector pan 3. As is known to the person skilled in the art of underground mining, a plough end stop can be fitted on the connector pan 3, for example on the connecting bracket 5, to prevent the mining plough from possibly destroying the motors for operating the mining device. The main field of application of the present invention concerns the wedge pan 2 and the adjoining connector pan 3, which each respectively have a here differently configured plough guide part 6 and 7, which forms a detachable attachment part and is connected to the associated trough pan 8 of the wedge pan 2 or trough pan 9 of the connector pan 3 as a detachable attachment part. As FIG. 1, in particular, clearly reveals, the guide elements on the two plough guide parts 6, 7 run at a slight oblique angle to the trough pans 8, 9, on account of which both plough guide parts 6, 7 are configured in the style of wedge pans. The plough guide part 6 has an inspection flap for the upper chain channel of a plough chain, which inspection flap is not present in respect of the plough guide part 7.

Figure 2:
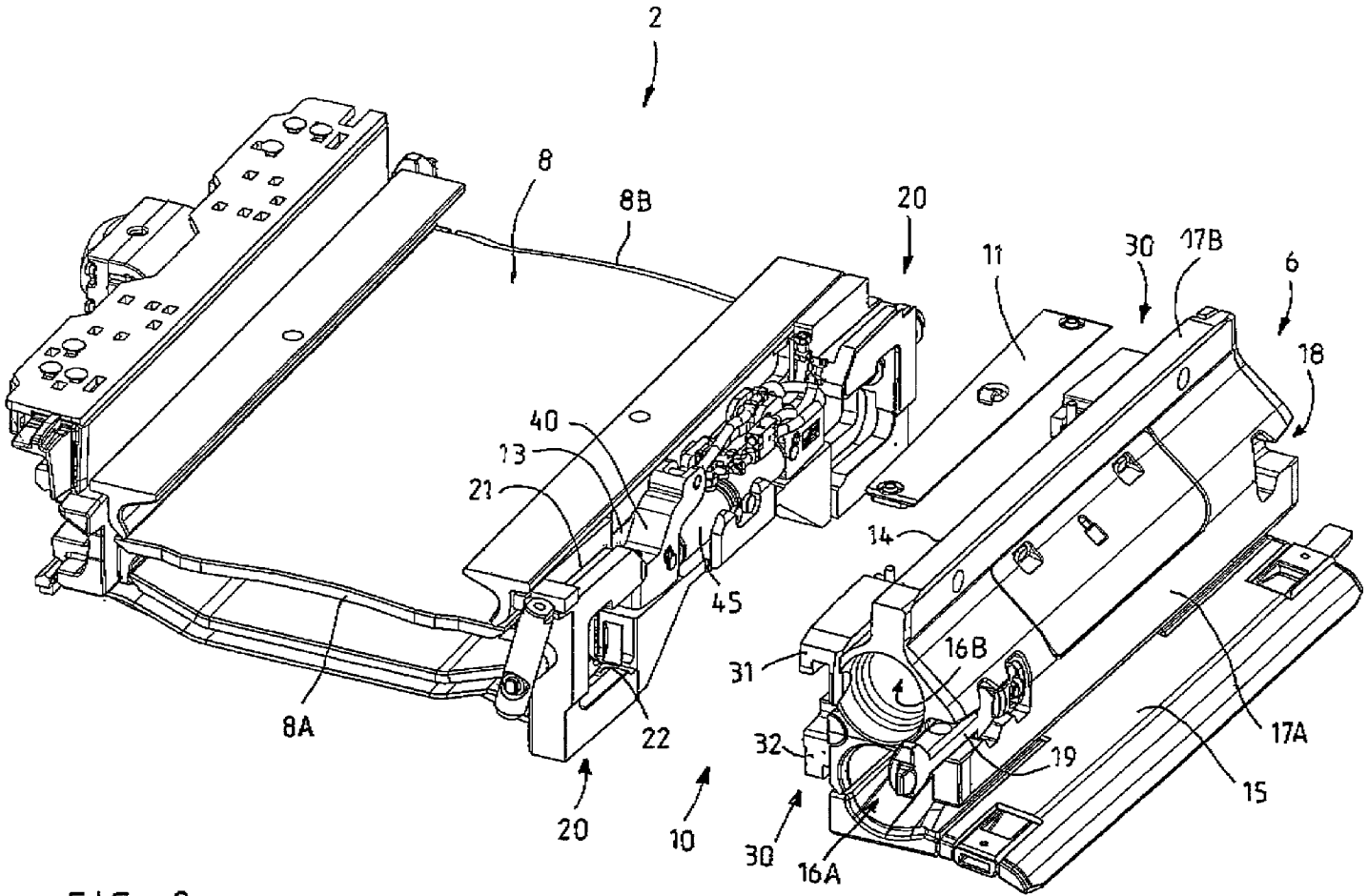
FIG. 2 shows in perspective representation a wedge pan according to the invention with detached guide part.

The invention relates to the device for fastening the detachable plough guide parts 6, 7 to the associated trough pans 8 and 9, which connector device, with the exception of removable closing plates 11, 12 assigned to the plough guide parts 6, 7, is not visible from the representation in FIG. 1. For the description of the connector device, reference is now made to FIGS. 2 to 7, in which the connector device according to the invention is described on the basis of the illustrative embodiment of the wedge pan 2. FIG. 2 shows in an exploded representation the trough pan 8 of the wedge pan 2, with detached machine guide part 6. The entire connector device 10 for detachably fastening the plough guide part 6 to the trough pan 8 is located between a possibly multipart lateral element 13 of the trough pan 8, situated on the working side, and a rear wall 14 on the attachment part 6, situated on the stowage side. For the detachable fastening, two fittings, respectively denoted in their entirety by the reference symbol 20, are preferably welded or screwed onto the lateral element 13. Each fitting 20 cooperates with a counter fitting 30, which is fastened, in particular welded, to the rear wall 14 of the plough guide part 6. As is already clearly revealed by FIG. 2, the counter fittings 30 of the plough guide part 6 here have two hook elements 31, 32 arranged vertically offset one above the other, with which the plough guide part 6 can be hung in grooved receptacles or grooves 21 and 22 on the fittings 20 on the trough pan. The fittings 20 and counter fittings 30 are respectively arranged close to the opposite ends 8A and 8B of the trough pan 8, and the counter fittings 30 are correspondingly arranged at the ends of the plough guide part 6. The plough guide part 6 has, in a manner which is known per se, a lower machine track 15, a lower chain channel 16A, which is open in the direction of the working face, an upper chain channel 16B, which is closed in the direction of the working face, a lower guide bar 17A and an upper guide bar 17B, on which runs a Gleithobel plough. For the fastening of adjacent pans one to another, toggle pockets 18 are provided on the machine guide part 6, into which strong toggles 19, once the pans are fitted, can be inserted and locked in place.

Figure 3:
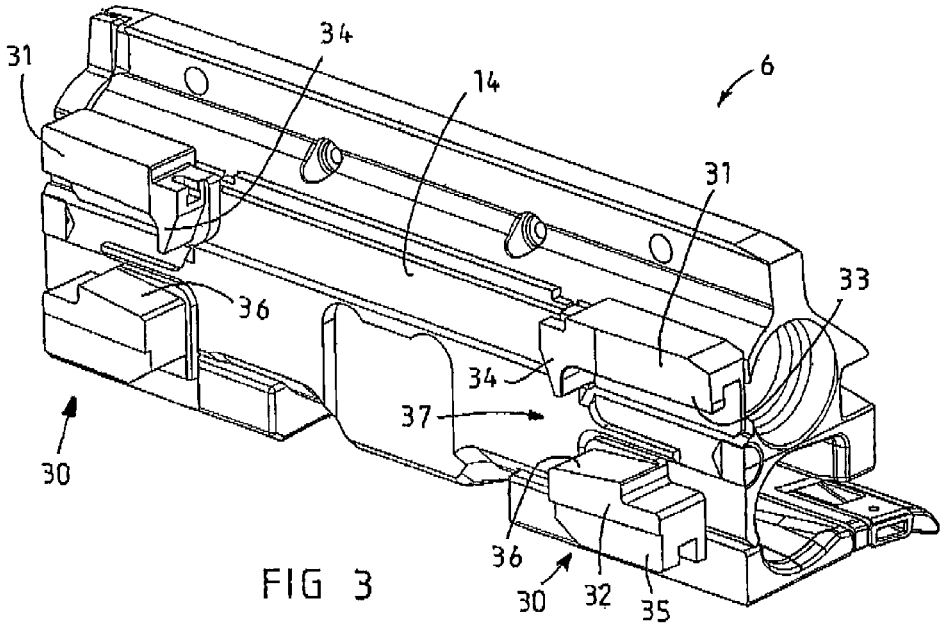
FIG. 3 shows in perspective representation the plough guide part in a view of its rear side with the counter fittings.

The configuration of the counter fittings 30 on the rear wall 14 of the plough guide part 6 can be seen particularly clearly from FIG. 3. The laterally spaced upper hook elements 31 are disposed in mirror-inverted arrangement to one another and have a downwardly projecting hook-in rib 33, which, in the direction of the middle of the machine guide part 6, respectively ends in a stop 34 that projects further downward. The lower hook elements 32 have an, in turn, downwardly projecting, U-shaped hooked bar 35, the top side of the lower hook elements 32 being formed by a slope 36 ascending outward in the direction of the ends of the plough guide parts 6. Between the upper hook elements 31 and the oblique face 36 on the lower hook elements 32, a relatively large interspace or clearance 37 is formed, so as to enable a retaining piece for locking in place the counter fitting 30 and the fitting (20, FIG. 2) to move into a subregion of this interspace 37, as will be further explained below. This is now explained with reference to the four further figures.

Figure 4:
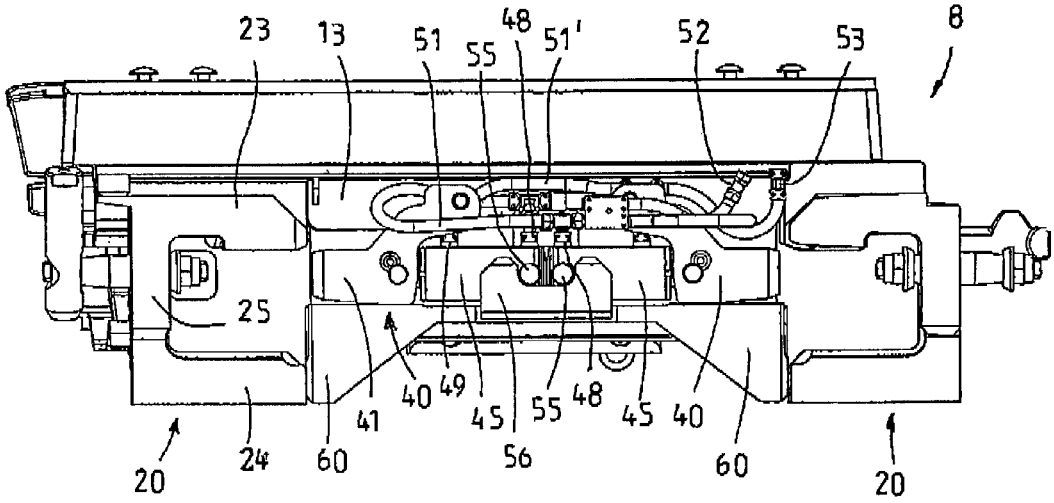
FIG. 4 shows a side view of the lateral element of the trough pan with the retaining pieces in opening position.
Figure 5:
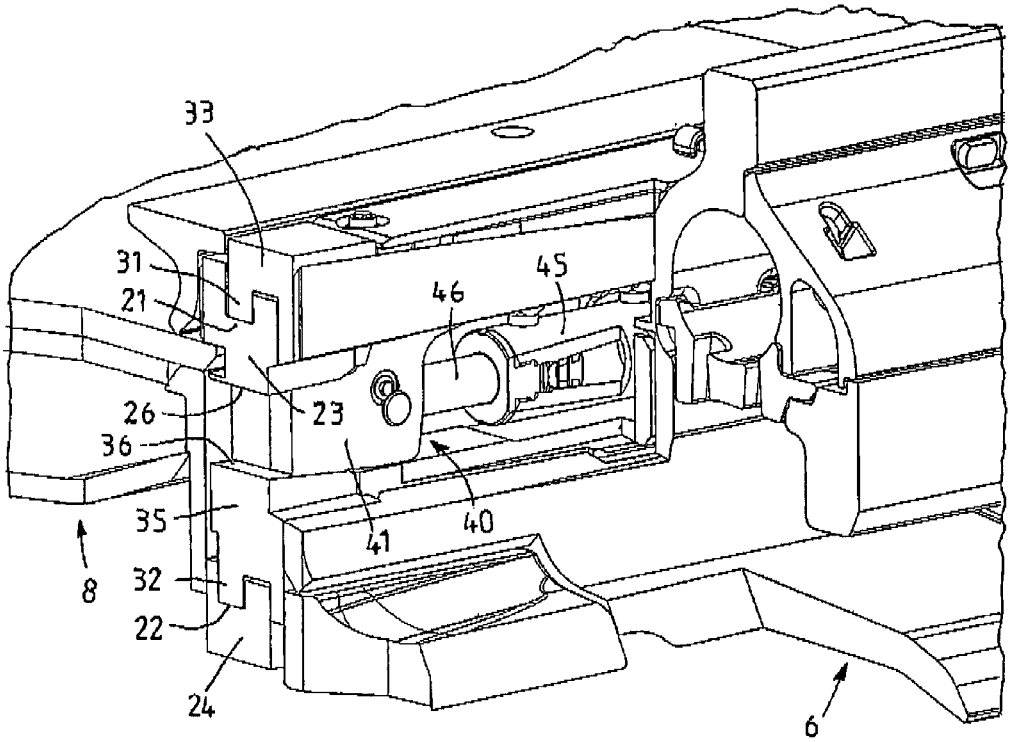
FIG. 5 shows in perspective representation, partially broken open, the wedge pan with fitted attachment part and retaining piece in the closing position.
Figure 6:
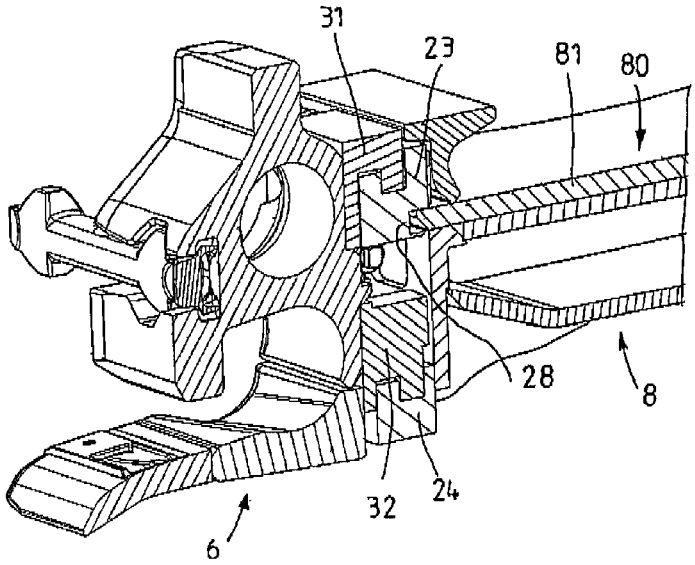
FIG. 6 shows a vertical section through the interlocking fittings and counter fittings in the trough pan according to the invention.

FIG. 4 shows a side view of the trough pan depicting the lateral element 13, to which the fittings 20 cooperating with the counter fittings are attached. The fittings 20 are also of mutually identical construction, but are arranged in mirror symmetry, and each fitting 20 here includes a strong, C-shaped profiled part having a mutually parallel upper end member 23 and lower end member 24, which end members are connected by a strong, vertically aligned transverse member 25. As can be inferred, in particular, from FIGS. 2, 5 and 6, the upper end members 23 have a groove 21, the groove width of which corresponds to the width of the hook-in rib 33 on the upper hook elements 31 of the counter fittings 30. The lower profiled members 24 have in turn, on the top side, a groove 22, the width of which corresponds to the width of the hooked bar 35 on the lower hook elements 32 of the counter fittings 30. The mutually coordinated widths of the grooves 21, 22 in the end members 23, 24 and of the hooked bars 33, 35, engaging positively therein, of the upper hook elements 31 and of the lower hook elements 32, can be recognized particularly clearly from FIGS. 5 and 6, which show the trough pan 8 and the machine guide part 6 in the assembly position, when both are connected to each other by means of the connector device. FIG. 5 here further shows that the locking between the hook elements 31, 32 of the counter fittings and the grooves 21, 22 in the end members 23, 24 of the fittings is secured by means of strong, here roughly swan-neck-shaped retaining pieces 40, which can be moved, preferably parallel to the direction of conveyance, between the closing position shown in FIG. 5 and an opening position shown, for example, in FIG. 2. The retaining pieces 40 have a lower locking member 41, here rectangular in cross section, which in the closing position is inserted positively between the oblique face 36 on the top side of the lower hook element 32 and the bottom side 26 of the upper end member 23 and, in this respect, also fills positively the interspace between the hook elements 31, 32 and the end members 23, 24 of the fittings and counter fittings. If the retaining piece 40 with the locking member 41 is in the closing position, the hook elements 32, 33 forming the counter fittings cannot move upward, with the result that the fittings and counter fittings cannot disengage and, due to the cross sections of locking piece 41, hook elements 31, 32 and grooves 21, 22 or end members 23, 24, any motional play is able to be prevented, even given the high forces generated in the mining operation. In the direction of conveyance, the stop bosses 34 on the upper hook elements 31 here prevent any movement between the trough pan 8 and the plough guide part 6, as will be readily apparent to the person skilled in the art.

FIG. 4 shows the retaining pieces 40 in the opening position. From FIG. 4 it can be clearly seen that, for the two laterally offset fittings 20 and counter fittings, a retaining piece 40 is respectively provided, in the opening position, as shown in FIG. 4, the distance between the two retaining pieces 40 being less than in the closing position, in which both retaining pieces 40 lie displaced outward. According to the invention, the movement of the retaining pieces 40 is respectively realized by means of a hydraulic cylinder 45 assigned to each retaining piece 40, which hydraulic cylinders, as shown by FIG. 5, respectively have a piston rod 46 attached to the retaining piece 40 by means of a bolt 47 or a clamp or the like. The two hydraulic cylinders 45 for the two retaining pieces 40 displaceable in opposite directions are disposed in mirror-inverted arrangement relative to each other, so that the left-hand hydraulic cylinder 45, in the extension movement, displaces the piston rod, and thus also the left-hand retaining piece 40, to the left, and the right-hand hydraulic cylinder 45 displaces the right-hand retaining piece 40 to the right. In the retraction movement, the displacement of the retaining pieces 40 is realized correspondingly the other way round. The piston rods of both hydraulic cylinders 45 lie on one axis, so that the forces can be mutually supported when the piston rods extend out from the hydraulic cylinders.

Both hydraulic cylinders 45 can be charged to both sides of a piston face (not represented) of the piston rod with hydraulic fluid, and can be constructed, in particular, as a hydraulic cylinder with unsupported piston. The hydraulic input 48 of both hydraulic cylinders 45 for the extension of the piston rods lies close to the here mutually abutting cylinder covers of the hydraulic cylinders 45, and the hydraulic input 49 for the return movement of the piston rods, and thus of the retaining pieces 40, into the opening position lies close to the opposite ends of the two hydraulic cylinders 45. Both hydraulic inputs 48 are connected by hoses 51 to a common hydraulic connection 52 for the pressurization for the extension movement, and the two hydraulic inputs 49 are connected by further hoses 51' to a second hydraulic connection 53 for the retraction movement of the retaining pieces 40. In the extension movement, the two hydraulic cylinders 45 are mutually supported with their cylinder covers. In the retraction movement, the two hydraulic cylinders 45 are supported by pins 55 against a here U-shaped mounting block 56.

If the attachment part 6 is now to be detached, the closing plate 11 shown, for example, in FIG. 2, which is fitted between the two counter fittings 30 on the plough guide part 6, must first be taken off in order to expose the two hydraulic connections 52, 53. Next, one of the two hydraulic connections, for example, for moving the retaining pieces 40 into the opening position, the hydraulic connection 53, can be connected to a hydraulic supply, for example the longwall hydraulics, in order to achieve a movement of the piston rods of the hydraulic cylinders 45 and to displace the retaining pieces 40 into the opening position. Since, in underground longwalls, a high hydraulic pressure is available, the retaining pieces 40 can be moved even when they are jammed with high force between the fittings and counter fittings. In principle, the miner needs no tool other than a connecting hose between the hydraulic connection 53 and the longwall hydraulics. If the retaining pieces 40 are in the opening position, the attachment part can be lifted out of the assembly position and maintenance works can be conducted, for example, on a mining plough transported into the longwall end region, once the plough guide part is removed. After this, the plough guide part (6, FIG. 2) can be hung with its counter fittings in the fittings 20 and, through hydraulic pressurization of the hydraulic connection 52, the retaining pieces 40 are displaced respectively outward to secure fitting and counter-fitting against detachment. As soon as the miner has then refitted the closing plate (11, FIG. 2), the mining installation is again ready for use. The retaining pieces 40 hereupon slide on strong guide pieces 60 beneath the hydraulic cylinders 45, in order that the locking members 41 can intrude cleanly and optimally into the interspace between the fittings.

FIG. 6 shows once again the positive locking between the interlocking hook elements 31, 32 and the end members 23, 24 of the counter fittings and fittings. From FIG. 6, as also from FIG. 5, it can be clearly seen that the trough pan 8 on which the machine guide part 6 is detachably fitted, as known per se in the prior art, can be provided with a replaceable feed tray (exchangeable tray 80), the conveyor floor 81 of the exchangeable tray engaging on the working face side, i.e. on that side on which the plough guide part 6 is fitted on the trough pan 8 and the coal is won, in a groove throat 28 on the stowage-side rear side of the upper end members 23 so as to lock the exchangeable tray 81 in place on the stowage side purely by way of the positive-locking interplay between the conveyor floor 81 of the exchangeable tray 80 and the fittings. In any event, the upper end members 23 of the C-shaped profiled parts hence fulfill a dual function, namely partially also the function of the one-sided locking of an exchangeable tray 81, so that it is only on the stowage side (here not represented) that the exchangeable tray has to be locked in place by means of detachable retaining means.

Figure 7:
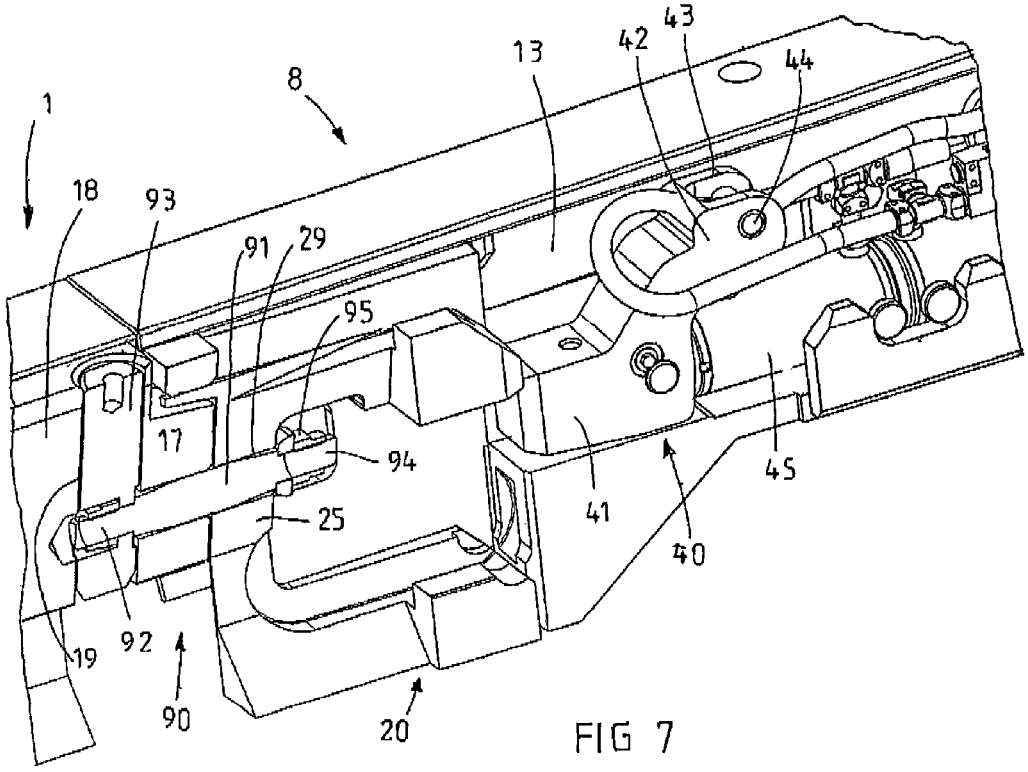
FIG. 7 shows the locking of a trough pan with detachable plough guide part to a trough pan with, for example, welded-on plough guide part.

In the underground operating use of a conveying system, all pans of the mining device are interconnected such that they can be angularly moved to a limited extent by means of the strong toggles 19 on the plough guide parts, as well as further toggles on the stowage side. In the case of removable plough guide parts, an interlocking, on the working face side, between the pan having the removable machine guide part and the directly following pan, for example a further wedge pan or, indeed, a normal pan, would be dispensed with. In the trough pan according to the invention, an additional centering and locking means 90 is therefore provided, the construction of which is now described with reference to FIG. 7. FIG. 7 here shows, once again, the trough pan 8 with the exchangeable tray 81 in a view of the lateral element 13 with the connector device comprising hydraulic cylinders 45, as well as with a displaceable retaining piece 40, as specifically described further above. The machine guide part attachable to the trough pan 8 is, however, disassembled. The pan adjoining the trough pan, for example a normal pan 1, is here provided with a non-removable, fixed machine guide (1A, FIG. 1), which in FIG. 7 is omitted for the sake of clarity. The transverse member 25 of the fittings 20 is provided with a transverse bore 29, which in the assembled state lies in alignment with and congruent to a transverse bore 17 in the end region of a side cheek 18 of the normal pan 1, which side cheek 18 is located on the working face side. The side cheek 18 is further provided with a vertical bore 19, in which the transverse bore 17 emerges. With the machine guide part removed from the trough pan 8, it is possible to stick through the mutually aligned transverse bores 17, 19 a centering bolt 91, which with its one bolt end 92 engages in a locking pin 93 that is inserted from above into the vertical bore 19 and is provided with a screw-in thread or the like. Screwed onto the other centering bolt end 94 is a retaining nut 95, so that although relative movements between the normal pan 1 and the trough pan 8 are still permitted, the two pans cannot move apart, including on the working face side. Due to the cylindrical locking pin 93 seated with play in the vertical bore, the normal pan 1 and the connected wedge pan 2 can still perform the necessary movements relative to each other. The centering means 90 can however only be detached once the plough guide part is disassembled. In the assembled state, on the other hand, the principal forces are not taken up by the centering means 90, but by the toggle connections on the plough guide parts 1A and 6.

As can be clearly seen, in particular, from FIG. 7, the retaining piece 40 ends above the locking member 41 in a short member part 42 with a forked end 43, to which, with disassembled hydraulic cylinders 45 and/or in case of failure of the hydraulic cylinders 45, a tool can be applied so as to be able to displace the retaining piece 40 between the closing position and the opening position, or vice versa. The tool can be applied, for instance, to a bolt 44 fitted at the forked end 43 of the retaining piece 40.

For the person skilled in the art, the preceding description will give rise to numerous modifications which shall fall within the range of protection of the appended claims. The figures show an advantageous illustrative embodiment. The lower hook elements and grooves of the fittings and counter fittings could also form a hook coupling, so as to be able to pivot the machine guide part into the assembly position before the retaining piece assumes its locking position or closing position. Self-evidently, the upper fittings and counter fittings are then not normally realized as positive locking means, but rather, for example, as a bar having a mutually fitting recess into which the retaining piece can be inserted. Such and other modifications shall fall within the range of protection of the appended claims. With the solution according to the invention, other attachment parts, in particular including roller bearing guides, etc., could also be detachably fastened to the trough pan.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A connector device for connecting an attachment part, in particular a plough guide part, to a lateral element of a trough pan of a mining device, comprising:

a first fitting arranged on the lateral element;

a counter fitting arranged on the attachment part and detachably connectable to the first fitting; and at least one retaining piece, which in a closing position prevents detachment of the first fitting and counter fitting and in an opening position permits detachment, wherein to the retaining piece there is assigned a hydraulic cylinder for moving the at least one retaining piece between the closing and opening position.

2. The connector device as claimed in claim 1, wherein two retaining pieces are provided and to each retaining piece there is respectively assigned a hydraulic cylinder.

3. The connector device as claimed in claim 2, wherein each hydraulic cylinder has an extensible and retractable piston rod connected to the associated retaining piece.

4. The connector as claimed in claim 2, wherein each hydraulic cylinder is provided with a piston rod lying aligned on an axis and arranged laterally inverted on the lateral element of the trough pan in such a way that the distance apart of the retaining pieces in the closing position is greater than in the opening position.

5. The connector device as claimed in claim 3, wherein each hydraulic cylinder has a common hydraulic connection for extension movement and a separate common hydraulic connection for retraction movement of the piston rods.

6. The connector device as claimed in claim 1, wherein each first fitting and counter fitting has first and second positive locking means, which are spaced apart one above the other by an interspace and which, in the assembled state, interlock, and the at least one retaining piece can respectively be slid into or out of the interspace.

7. The connector device as claimed in claim 6, wherein the counter fitting is configured as hook elements, which can be hung in grooves on the first fitting.

8. The connector device as claimed in claim 1, wherein the first fitting includes C-shaped profiled parts having respectively two end members and a transverse member connecting these same, the transverse member including a transverse bore for receiving a centering element for the centering and connection of the trough pans.

9. The connector device as claimed in claim 1, wherein the at least one retaining piece rests displaceably on a guide piece attached to the lateral element.

10. The connector device as claimed in claim 1, wherein the first fitting and the counter fitting include bars, which allow a hanging fastening of the attachment part to the lateral element.

11. The connector device as claimed in claim 1, wherein the at least one retaining piece is movable parallel to the lateral element.

12. An attachment part for a connector device as claimed in claim 1, wherein the attachment part is configured as a plough guide part and is provided between the counter fittings with a removable closing plate in order, when the closing plate is removed, to expose hydraulic connections for actuating the hydraulic cylinders of the connector device.

13. The connector device of claim 9, wherein the at least one retaining piece rests displaceably on a guide piece welded to the lateral element.

14. A trough pan with detachable attachment part, in particular a trough pan with detachable machine guide, for mining equipment for mineral mining, wherein the attachment part is detachably fastenable by a connector device which has a fitting on the trough pan, a counter fitting on the attachment part, and at least one retaining piece, which in a closing position prevents detachment of the fitting and counter fitting, wherein the connector device has a hydraulic cylinder, assigned to the retaining piece and abutted against the lateral element, for moving the retaining piece between an opening position and the closing position in which the retaining piece prevents detachment of the fitting and counter fitting.

15. The trough pan as claimed in claim 14, wherein the connector device is configured according to claim 1.

16. The trough pan as claimed in claim 14, wherein the machine guide includes a plough guide part.

17. An attachment part for a trough pan as claimed in claim 14, wherein the attachment part is configured as a plough guide part and is provided between the counter fitting with a removable closing plate in order, when the closing plate is removed, to expose hydraulic connections for actuating the hydraulic cylinder of the connector device.

18. The trough pan as claimed in claim 14, wherein the machine guide includes a plough guide part for wedge or connector pans in the end region of a mining device.

* * * * *